US009359575B2

(12) United States Patent
Malshe

(10) Patent No.: US 9,359,575 B2
(45) **Date of Patent: *Jun. 7, 2016**

(54) NANOPARTICLE MACRO-COMPOSITIONS

(71) Applicant: NanoMech, Inc., Springdale, AR (US)

(72) Inventor: Ajay P. Malshe, Springdale, AR (US)

(73) Assignee: NanoMech, Inc., Fayetteville, AK (US)

( * ) Notice: Subject to any disclaimer, the term of this patent is extended or adjusted under 35 U.S.C. 154(b) by 266 days.

This patent is subject to a terminal disclaimer.

(21) Appl. No.: 13/906,535

(22) Filed: May 31, 2013

(65) Prior Publication Data

US 2014/0005085 A1 Jan. 2, 2014

Related U.S. Application Data

(63) Continuation of application No. 13/540,235, filed on Jul. 2, 2012, now Pat. No. 8,476,206.

(51) Int. Cl.
*C10M 125/00* (2006.01)
*C10M 171/06* (2006.01)
(Continued)

(52) U.S. Cl.
CPC ..... *C10M 141/00* (2013.01); *C10M 129/74* (2013.01); *C10M 171/06* (2013.01);
(Continued)

(58) Field of Classification Search
CPC ..... C10M 141/00; C10M 129/74; C10M 171/06; C10M 2201/066; C10M 2223/045; C10N 2210/01; C10N 2220/082; C10N 2220/084; C10N 2220/086; C10N 2230/56; C10N 2240/04; C10N 2250/10; C10N 2270/00
USPC ..... 508/165, 498
See application file for complete search history.

(56) References Cited

U.S. PATENT DOCUMENTS 4,105,571 A 8/1978 Shaub et al.
4,168,241 A 9/1979 Kozima et al.
(Continued)

FOREIGN PATENT DOCUMENTS

CN 1080648 1/1994
JP 63-040708 2/1988
(Continued)

OTHER PUBLICATIONS

JP Patent Office, Office Action dated May 25, 2015, from JP Patent Application No. 2014-095260 (with English Translation).
(Continued)

*Primary Examiner* — James Goloboy
(74) *Attorney, Agent, or Firm* — Akerman LLP; Stephen C. Glazier

(57) ABSTRACT

Embodiments of the present invention may include a macro-composition with a special structure. The structure includes a layered macro-composition made of a nanoparticle as an inner nucleus, an intermediate layer around the nucleus, and an outer layer intercalated with the nucleus or encapsulating the nucleus and the intermediate layer. A plurality of the layered macro-compositions is bonded together by bonds, so that each layered macro-composition is bonded to at least one other such layered macro-composition. Embodiments include a macro-composition made of three 3-layered macro-compositions joined in a chain by two bonds. These macro-composition assemblies may take the shape of layered macro-compositions bonded together in chains, or forming other shapes, such as rings. The layered macro-composition may be no more than about 100 nanometers in size, for example. The bonds of the complex macro-composition may have an average length of no more than about 100 nanometers, for example. Embodiments may be added to lubricants such as oil or grease, to increase their performance.

24 Claims, 5 Drawing Sheets

(51) Int. Cl.

| | |
|---|---|
| ***C10M 141/06*** | (2006.01) |
| ***C10M 129/74*** | (2006.01) |
| ***C10M 141/00*** | (2006.01) |

(52) U.S. Cl.

CPC ... *C10M2201/066* (2013.01); *C10M 2223/045* (2013.01); *C10N 2210/01* (2013.01); *C10N 2220/082* (2013.01); *C10N 2220/084* (2013.01); *C10N 2220/086* (2013.01); *C10N 2230/56* (2013.01); *C10N 2240/04* (2013.01); *C10N 2250/10* (2013.01); *C10N 2270/00* (2013.01)

(56) References Cited

U.S. PATENT DOCUMENTS

| | | | |
|---|---|---|---|
| 4,223,958 | A | 9/1980 | Gray |
| 4,334,928 | A | 6/1982 | Hara et al. |
| 4,715,972 | A | 12/1987 | Pacholke |
| 4,745,010 | A | 5/1988 | Sarin et al. |
| 4,816,334 | A | 3/1989 | Yokoyama et al. |
| 4,877,677 | A | 10/1989 | Hirochi et al. |
| 5,129,918 | A | 7/1992 | Chattopadhay |
| 5,273,790 | A | 12/1993 | Herb et al. |
| 5,286,565 | A | 2/1994 | Holzi et al. |
| 5,328,875 | A | 7/1994 | Ueda et al. |
| 5,330,854 | A | 7/1994 | Singh et al. |
| 5,352,501 | A | 10/1994 | Miyamoto et al. |
| 5,363,821 | A | 11/1994 | Rao et al. |
| 5,389,118 | A | 2/1995 | Hinterman et al. |
| 5,391,422 | A | 2/1995 | Omori et al. |
| 5,407,464 | A | 4/1995 | Kaliski |
| 5,441,762 | A | 8/1995 | Gray et al. |
| 5,466,642 | A | 11/1995 | Tajima et al. |
| 5,478,622 | A | 12/1995 | Nakamura et al. |
| 5,500,331 | A | 3/1996 | Czekai et al. |
| 5,503,913 | A | 4/1996 | Konig et al. |
| 5,523,006 | A | 6/1996 | Strumban |
| 5,534,808 | A | 7/1996 | Takaki et al. |
| 5,536,577 | A | 7/1996 | Murayama et al. |
| 5,614,140 | A | 3/1997 | Pinneo |
| 5,671,532 | A | 9/1997 | Rao et al. |
| 5,677,060 | A | 10/1997 | Terentieva et al. |
| 5,704,556 | A | 1/1998 | McLaughlin |
| 5,766,783 | A | 6/1998 | Utsumi et al. |
| 5,800,866 | A | 9/1998 | Myers et al. |
| 5,830,577 | A | 11/1998 | Murayama et al. |
| 5,830,813 | A | 11/1998 | Yao et al. |
| 5,834,689 | A | 11/1998 | Cook |
| 5,882,777 | A | 3/1999 | Kukino et al. |
| 5,889,219 | A | 3/1999 | Moriguchi |
| 5,897,751 | A | 4/1999 | Makowiccki et al. |
| 5,902,671 | A | 5/1999 | Kutscher |
| 5,928,771 | A | 7/1999 | DeWald, Jr. et al. |
| 5,945,166 | A | 8/1999 | Singh et al. |
| 6,146,645 | A | 11/2000 | Deckers et al. |
| 6,183,762 | B1 | 2/2001 | Deckers et al. |
| 6,196,910 | B1 | 3/2001 | Johnson et al. |
| 6,210,742 | B1 | 4/2001 | Deckers et al. |
| 6,217,843 | B1 | 4/2001 | Homyonfer et al. |
| 6,258,139 | B1 | 7/2001 | Jensen |
| 6,258,237 | B1 | 7/2001 | Gal-Or et al. |
| 6,370,762 | B1 | 4/2002 | Li et al. |
| 6,372,012 | B1 | 4/2002 | Majagi et al. |
| 6,383,404 | B1 | 5/2002 | Sakai et al. |
| 6,395,634 | B1 | 5/2002 | Miyamoto |
| 6,410,086 | B1 | 6/2002 | Brandon et al. |
| 6,484,826 | B1 | 11/2002 | Anderson et al. |
| 6,540,800 | B2 | 4/2003 | Sherman et al. |
| 6,544,599 | B1 | 4/2003 | Brown et al. |
| 6,548,139 | B2 | 4/2003 | Sakai et al. |
| 6,548,264 | B1 | 4/2003 | Tan et al. |
| 6,607,782 | B1 | 8/2003 | Malshe et al. |
| 6,652,967 | B2 | 11/2003 | Yadav et al. |
| 6,709,622 | B2 | 3/2004 | Billiet et al. |
| 6,710,020 | B2 | 3/2004 | Tenne et al. |
| 6,878,676 | B1 | 4/2005 | Migdal et al. |
| 6,895,855 | B2 | 5/2005 | Doll |
| 6,933,049 | B2 | 8/2005 | Wan et al. |
| 6,933,263 | B2 | 8/2005 | Manka et al. |
| 6,945,699 | B2 | 9/2005 | Tibbits |
| 6,951,583 | B2 | 10/2005 | Clere et al. |
| 6,962,895 | B2 | 11/2005 | Scharf et al. |
| 6,962,946 | B2 | 11/2005 | Brady et al. |
| 6,976,647 | B2 | 12/2005 | Reed et al. |
| 7,018,606 | B2 | 3/2006 | Tenne et al. |
| 7,018,958 | B2 | 3/2006 | Arrowsmith et al. |
| 7,022,653 | B2 | 4/2006 | Hartley et al. |
| 7,244,498 | B2 | 7/2007 | Cook et al. |
| 7,335,245 | B2 | 2/2008 | He et al. |
| 7,371,474 | B1 | 5/2008 | Liu et al. |
| 7,372,615 | B2 | 5/2008 | Chen et al. |
| 7,374,473 | B2 | 5/2008 | Kumasaka et al. |
| 7,375,060 | B2 | 5/2008 | Kuzmin et al. |
| 7,387,813 | B2 | 6/2008 | Kumar et al. |
| 7,410,697 | B2 | 8/2008 | Schneider et al. |
| 7,419,941 | B2 | 9/2008 | Waynick |
| 7,430,359 | B2 | 9/2008 | Chen et al. |
| 7,438,976 | B2 | 10/2008 | He et al. |
| 7,449,432 | B2 | 11/2008 | Lockwood et al. |
| 7,458,384 | B1 | 12/2008 | Seal et al. |
| 7,463,404 | B2 | 12/2008 | Chen et al. |
| 7,470,650 | B2 | 12/2008 | Zhang et al. |
| 7,471,439 | B2 | 12/2008 | Chen et al. |
| 7,494,907 | B2 | 2/2009 | Brown et al. |
| 7,510,760 | B2 | 3/2009 | Malshe et al. |
| 7,524,481 | B2 | 4/2009 | Tenne et al. |
| 7,549,938 | B2 | 6/2009 | Leighton et al. |
| 7,556,743 | B2 | 7/2009 | Furman et al. |
| 7,571,774 | B2 | 8/2009 | Shuster et al. |
| 7,580,174 | B2 | 8/2009 | Chen et al. |
| 7,594,962 | B2 | 9/2009 | Bujard et al. |
| 7,597,950 | B1 | 10/2009 | Stellacci et al. |
| 7,614,270 | B2 | 11/2009 | Luckey, Jr. et al. |
| 7,616,370 | B2 | 11/2009 | Chen et al. |
| 7,641,886 | B2 | 1/2010 | Tenne et al. |
| 7,687,112 | B2 | 3/2010 | Buehler et al. |
| 7,704,125 | B2 | 4/2010 | Roy et al. |
| 7,723,812 | B2 | 5/2010 | Chen et al. |
| 7,749,562 | B1 | 7/2010 | Lam et al. |
| 7,763,489 | B2 | 7/2010 | Chen et al. |
| 7,767,632 | B2 | 8/2010 | Esche, Jr. et al. |
| 7,768,366 | B1 | 8/2010 | Patton et al. |
| 7,771,821 | B2 | 8/2010 | Martin et al. |
| 7,790,658 | B2 | 9/2010 | Sawyer et al. |
| 7,803,347 | B2 | 9/2010 | Ajiri |
| 7,816,297 | B2 | 10/2010 | Lee |
| 7,846,556 | B2 | 12/2010 | Erdemir et al. |
| 7,871,533 | B1 | 1/2011 | Haiping et al. |
| 7,952,786 | B2 | 5/2011 | Chen et al. |
| 7,955,857 | B2 | 6/2011 | Bastide et al. |
| 7,959,891 | B2 | 6/2011 | Tenne et al. |
| 7,968,505 | B2 | 6/2011 | Liu et al. |
| 7,994,105 | B2 | 8/2011 | Narayan |
| 7,998,572 | B2 | 8/2011 | McGilvray et al. |
| 8,048,526 | B2 | 11/2011 | Mizrahi |
| 8,071,160 | B2 | 12/2011 | Chinn et al. |
| 8,074,906 | B2 | 12/2011 | Talton |
| 8,075,792 | B1 | 12/2011 | Branz et al. |
| 8,076,809 | B2 | 12/2011 | Tingler et al. |
| 8,114,373 | B2 | 2/2012 | Jang et al. |
| 8,117,902 | B2 | 2/2012 | Santore et al. |
| 8,221,828 | B2 | 7/2012 | Chinn et al. |
| 8,322,754 | B2 | 12/2012 | Carcagno et al. |
| 8,476,206 | B1 * | 7/2013 | Malshe ..... C10M 141/00 508/165 |
| 8,486,870 | B1 | 7/2013 | Malshe |
| 8,492,319 | B2 | 7/2013 | Malshe et al. |
| 2004/0229039 | A1 | 11/2004 | Wei |
| 2005/0002970 | A1 | 1/2005 | Ketelson et al. |
| 2005/0065044 | A1 | 3/2005 | Migdal et al. |
| 2005/0124504 | A1 | 6/2005 | Zhang et al. |
| 2005/0191357 | A1 | 9/2005 | Kawashima et al. |
| 2006/0025515 | A1 | 2/2006 | Scaringe et al. |
| 2006/0056752 | A1 | 3/2006 | Tibbits |

(56) References Cited

U.S. PATENT DOCUMENTS

| | | | |
|---|---|---|---|
| 2006/0120947 | A1 | 6/2006 | Tenne et al. |
| 2007/0004602 | A1 | 1/2007 | Waynick |
| 2007/0158609 | A1 | 7/2007 | Hong et al. |
| 2007/0158610 | A1 | 7/2007 | Hong et al. |
| 2007/0262120 | A1 | 11/2007 | Coleman et al. |
| 2007/0293405 | A1 | 12/2007 | Zhang et al. |
| 2008/0029625 | A1 | 2/2008 | Talton |
| 2008/0050450 | A1 | 2/2008 | Arnold et al. |
| 2008/0066375 | A1 | 3/2008 | Roos et al. |
| 2008/0161213 | A1 | 7/2008 | Jao et al. |
| 2008/0234149 | A1 | 9/2008 | Malshe et al. |
| 2008/0269086 | A1 | 10/2008 | Adhvaryu |
| 2008/0287326 | A1 | 11/2008 | Zhang et al. |
| 2008/0312111 | A1* | 12/2008 | Malshe ..... C10M 171/06 508/155 |
| 2009/0014691 | A1 | 1/2009 | Kint et al. |
| 2009/0018037 | A1 | 1/2009 | Mabuchi et al. |
| 2009/0048129 | A1 | 2/2009 | Mabuchi et al. |
| 2009/0053268 | A1 | 2/2009 | DePablo et al. |
| 2009/0074522 | A1 | 3/2009 | Graham et al. |
| 2009/0118148 | A1 | 5/2009 | Martin et al. |
| 2009/0124780 | A1 | 5/2009 | Jacobson |
| 2009/0155479 | A1 | 6/2009 | Xiao et al. |
| 2009/0169745 | A1 | 7/2009 | Nohr et al. |
| 2009/0170733 | A1 | 7/2009 | Hwang et al. |
| 2009/0246285 | A1 | 10/2009 | Stellacci et al. |
| 2010/0029518 | A1 | 2/2010 | Markovitz et al. |
| 2010/0092663 | A1 | 4/2010 | Ajiri |
| 2010/0099590 | A1 | 4/2010 | Liu |
| 2010/0204072 | A1 | 8/2010 | Kwon et al. |
| 2010/0227782 | A1 | 9/2010 | Tenne et al. |
| 2010/0261625 | A1 | 10/2010 | Hakamata |
| 2010/0272931 | A1 | 10/2010 | Stavlid |
| 2010/0298180 | A1 | 11/2010 | Patel et al. |
| 2011/0118156 | A1 | 5/2011 | Ruhle et al. |
| 2011/0136708 | A1 | 6/2011 | Mabuchi et al. |
| 2011/0166051 | A1 | 7/2011 | Mizrahi et al. |
| 2011/0172132 | A1 | 7/2011 | Branson et al. |
| 2011/0206596 | A1 | 8/2011 | Tenne et al. |
| 2011/0229580 | A1* | 9/2011 | Srivastava ..... A61K 9/1652 424/493 |
| 2011/0244692 | A1 | 10/2011 | Jeong et al. |
| 2011/0257054 | A1 | 10/2011 | Baran, Jr. et al. |
| 2011/0287987 | A1 | 11/2011 | Mordukhovich et al. |
| 2012/0032543 | A1 | 2/2012 | Chakraborty et al. |
| 2012/0100438 | A1 | 4/2012 | Fasching et al. |

FOREIGN PATENT DOCUMENTS

| | | | |
|---|---|---|---|
| JP | 10130678 | A | 5/1998 |
| JP | 10195473 | A | 7/1998 |
| JP | 10330779 | A | 12/1998 |
| JP | 2002-294272 | | 10/2002 |
| JP | 2006-045350 | | 2/2006 |
| WO | WO 95/02025 | A1 | 1/1995 |
| WO | WO 98/24833 | A1 | 6/1998 |
| WO | WO 2005/060648 | | 7/2005 |
| WO | WO 2006/076728 | | 7/2006 |
| WO | WO 2006/134061 | | 12/2006 |
| WO | WO 2007/082299 | | 7/2007 |
| WO | WO 2014/008004 | | 1/2014 |

OTHER PUBLICATIONS

Bakunin, V.N. et al., "Synthesis and application of inorganic nanoparticles as lubricant components—a review", J. Nanoparticle Res. (2004) 6:273-284.

Dmytryshyn, S.L., et al., "Synthesis and characterization of vegetable oil derived esters: evaluation for their diesel additive properties", Bioresource Tech. (2004) 92:55-64.

Hsu, S.M., et al., "Boundary lubricating films: formation and lubrication mechanism", Tribology Int'l (2005) 38:305-312.

Hu, J.J. et al., "Synthesis and microstructural characterization of inorganic fullerene-like MoS2 and graphite-MoS2 hybrid nanoparticles", J. Mater. Res. (2006) 21(4):1033-1040.

Jiang, W. et al., "Cubic boron nitride (cBN) based nanocomposite coatings on cutting inserts with chip breakers for hard turning applications", Surface & Coatings Technology (2005) 200:1849-1854.

Li, B. et al., "Tribochemistry and antiwear mechanism of organic-inorganic nanoparticles as lubricant additives", Technology Letters (2006) 22(1):79-84.

Malshe, A.P. et al., "Nanostructured coatings for machining and wear-resistant applications", JOM (2002) 28-30.

Menezes, P.L. et al., "Studies on friction and transfer layer: role of surface texture", Tribology Letter (2006) 24(3):265-273.

Minami, I. et al., "Antiwear properties of phosphorous-containing compounds in vegetable oils", Tribology Letter (2002) 13(2):95-101.

Moshkovith, A. et al., "Friction of fullerene-like WS2 nanoparticles; effect of agglomeration", Tribology Letter (2006) 24(3):225-228.

Ozkan et al., "Femtosecond laser-induced periodic structure writing on diamond crystals and microclusters", Applied Physics Letters, vol. 75, No. 23, Dec. 6, 1999, pp. 3716-3718.

Rao, C.N.R. et al., "Inorganic nanotubes", Dalton Trans. (2003) 1-24.

Russell, W.C. et al., "CBN-TiN composite coating using a novel combinatorial method—structure and performance in metal cutting", J. Mfg. Sci. Eng. (2003) 125:431-434.

Spikes, H., The thickness, friction and wear of lubricant files, a PowerPoint presentation given at the SAE Powertrain & Fluid Systems Conference and Exhibition, San Antonio, Texas (Oct. 25, 2005).

Verma, A. et al., "Exploring mechanical synthesis of inorganic nanoparticles of MoS2 lubricant and its composite with organic medium for advanced manufacturing", ISNM (2006) Paper No. 33.

Wu, J.-H. et al., "Bio-inspired surface engineering and tribology of MoS2 overcoated cBN-TiN composite coating", Wear (2006) 261(5-6):592-599.

Yedave, S.N. et al., "Novel composite CBN-TiN coating; synthesis and performance analysis", J. Mfg. Processes (2003) 5(2):154-162.

Spalvins, T. "A review of recent advances in solid film lubrication", J. Vac. Sci. Technol/ A (1987) 5(2):212-219.

Canter, Dr. Neil, "EP nanoparticles-based lubricant package", Tribology & Lubrication Technology, Apr. 2009, pp. 12-17.

Demydov, Ph.D., Dmytro, "Progress Report (2nd Quarter) Advanced Lubrication for Energy Efficiency, Durability and Lower Maintenance Costs of Advanced Naval Components and Systems", NanoMech, LLC, prepared for Office of Naval Research for the period of Feb. 20, 2010-May 19, 2010, 34 pages.

Verma et al., "Tribological Behavior of Deagglomerated Active Inorganic Nanoparticles for Advanced Lubrication", Tribology Transactions, Sep. 1, 2008, 51: pp. 673-678.

Adhvaryu, Dr. Antanu, "Multi-component Nanoparticle Based Lubricant Additive to Improve Efficiency and Durability in Engines", Caterpillar Inc., Aug. 7, 2008, 27 pages.

Verma, Arpana, "Fundamental Understanding of the Synthesis and Tribological Behavior of Organic-Inorganic Nanoparticles", Dec. 2008, University of Arkansas, 147 pages.

Berdinsky et al., "Synthesis of MoS2 nanostructures from nano-size powder by thermal annealing", Electron Devices and Materials (2000), EDM (2000) Siberian Russian Student Workshops on Sep. 19-21, 2000, Piscataway, NJ, UsA, pp. 20-28.

Cizaire et al., "Mechanisms of ultra-low friction by hollow inorganic fullerene-like MoS2 nanoparticles", Surface and Coatings Technology (2002) 160(2-3): pp. 282-287.

Huang et al., "Friction and wear properties of IF-MOS2 as additive in Paraffin oil," Tribology Letters, vol. 20, Nos. 3-4, Dec. 2005, pp. 247-250.

Rapoport et al., "Fullerene-like WS2 nanoparticles: superior lubricants for harsh conditions", Advanced Materials, Apr. 17, 2003, vol. 15, Nos. 7-8, pp. 651-655.

Hu, Xianguo, "On the size effect of molybdenum disulfide particles on tribological performance", Industrial Lubrication and Tribology, 2005, vol. 57, Issue 6, pp. 255-259.

* cited by examiner

NANOPARTICLE MACRO-COMPOSITIONS

CROSS-REFERENCE TO RELATED APPLICATIONS

This patent application is a continuation application and claims the benefit of the filing date under 35 U.S.C. §120 of U.S. patent application Ser. No. 13/540,235, filed on Jul. 2, 2012, now U.S. Pat. No. 8,476,206 B1, issued on Jul. 2, 2013. U.S. patent application Ser. No. 13/540,235 is incorporated by reference into this specification.

BACKGROUND

1. Field of Invention

Embodiments of the present invention relate generally to nanomaterials. More specifically, embodiments relate to nanomaterials used with other substances for lubricants, and other purposes.

2. Description of Related Art

Nanomaterials have been developed and used for lubrication and other purposes. Nanomaterials have also been used with other materials for lubrication and other purposes. However, this knowledge is still in its infancy and a need exists to improve the design and use of nanomaterials for lubrication and other purposes.

SUMMARY

Embodiments of the present invention may include a macro-composition with a special structure. The structure includes a layered macro-composition made of a nanoparticle as an inner nucleus, an intermediate layer around the nucleus, and an outer layer intercalated with the nucleus or encapsulating the nucleus and the intermediate layer. A plurality of the layered macro-compositions is bonded together by bonds, so that each layered macro-composition is bonded to at least one other such layered macro-composition. Embodiments include a macro-composition made of three 3-layered macro-compositions joined in a chain by two bonds. These macro-composition assemblies may take the shape of layered macro-compositions bonded together in chains, or forming other shapes, such as rings. The layered macro-composition may be no more than about 100 nanometers in size, for example. The bonds of the complex macro-composition may have an average length of no more than about 100 nanometers, for example. Embodiments may be added to lubricants such as oil or grease, to increase their performance.

BRIEF DESCRIPTION OF THE DRAWINGS

Embodiments of the present invention are described herein, by way of example, in conjunction with the following figures.

EMBODIMENTS OF THE PRESENT INVENTION

Embodiments of the present invention may include a macro-composition with a special structure. The structure includes a layered macro-composition (see FIG. 1) comprising a nanoparticle an inner nucleus 1030, an intermediate layer 1020 encapsulating the nucleus 1030, and an outer layer 1010 encapsulating the nucleus 1030 and the intermediate layer 1020. The intermediate layer 1020 and the outer layer 1010 may also be intercalated with the nucleus 1030. A plurality of the layered macro-compositions 2010, 2020, 2030 are bonded together by bonds 2040, 2050, so that each layered macro-composition is bonded to at least one other such layered macro-composition (see FIG. 2). FIG. 2 shows a macro-composition comprising three layered macro-compositions 2010, 2020, 2030 joined in a chain by two bonds 2040, 2050. These bonded assemblies of macro-compositions may take the shape of layered macro-compositions bonded together in longer chains, or forming other shapes, such as rings, for example. In some embodiments, the layered macro-composition 2010 may be no more than about 100 nanometers in size. In some embodiments, the bonds 2040 of the complex macro-composition may have an average length of no more than about 100 nanometers.

An alternative embodiment of the present invention may include a macro-composition with an alternative structure. This structure may include an alternative layered macro-composition comprising a plurality of nanoparticle inner nuclei 1030, and on each nucleus, an outer layer 1010 intercalated with the nucleus and/or encapsulating the nucleus, such that the layer 1010 with the nucleus 1030 form a layered nanoparticle; and a plurality of bonds 2040, 2050, each bond bonded to at least two of the layered nanoparticles, such that each layered nanoparticle is bonded to at least one other of the layered nanoparticles by a bond. These alternative macro-compositions may take the shape of the alternative layered macro-compositions bonded together in chains, or forming other shapes, such as rings, for example. These bonded macro-compositions are structured like the compositions in FIG. 2, except that the macro-compositions 2010, 2020, 2030 in this embodiment may have no intermediate layer 1020.

Macro-composition is a term used by the applicants to describe embodiments of the present invention. Embodiments of the present invention may also sometimes be referred to herein as macromolecules, or polynanomers. Embodiments of the macro-composition, including as shown in FIG. 1 and 2010, 2020, 2030, may be available from NanoMech, Inc., in Springdale, Ark.

Figure 1:
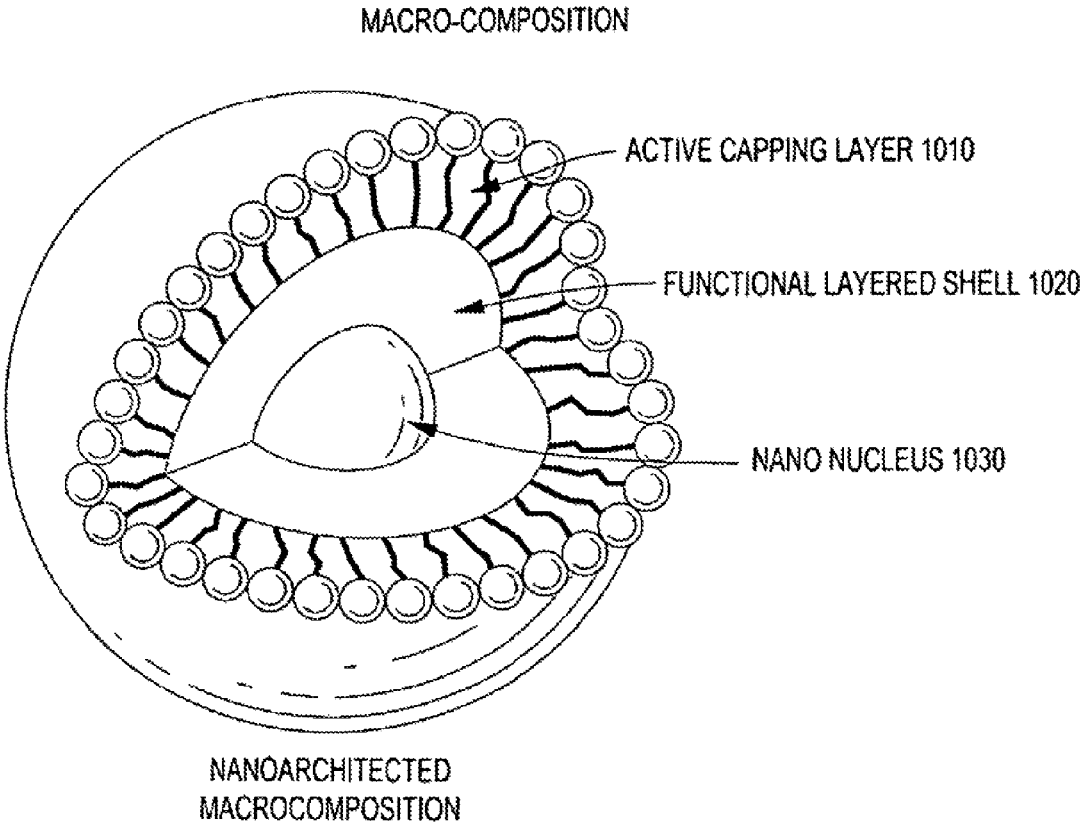
FIG. 1 is a schematic diagram showing a nanoparticle macro-composition comprising an inner nucleus, an intermediate layer, and an outer layer.
Figure 2:
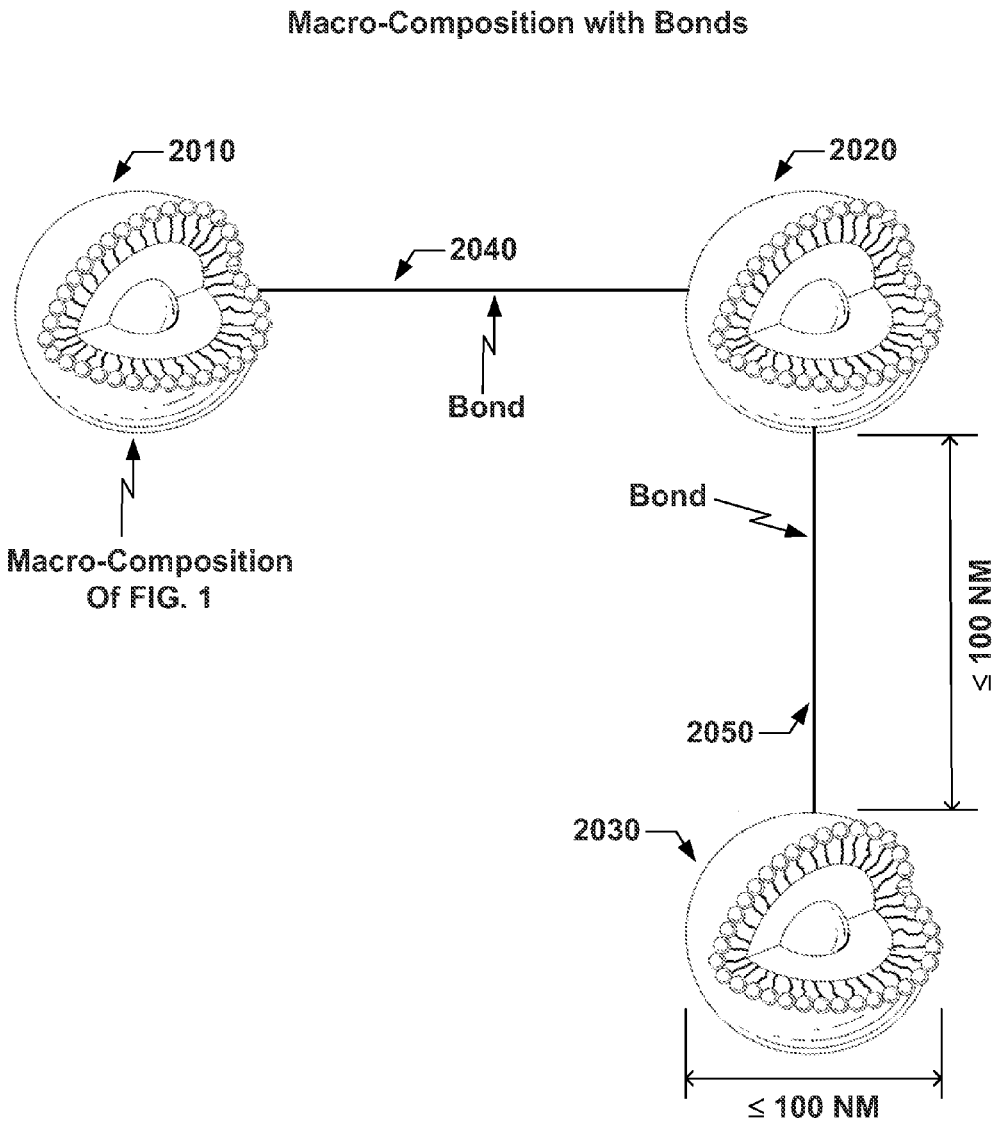
FIG. 2 is a schematic diagram showing a bonded assembly of nanoparticle macro-compositions each comprising an inner nucleus, an intermediate layer, and an outer layer.

Embodiments of the present invention are shown in FIG. 1, and may include a layered nanoparticle macro-composition, comprising a nanoparticle inner nucleus 1030, a intermediate layer 1020 around the nucleus 1030, which may be a functional layered shell, 1030, and an outer layer 1010, which may be an active capping layer 1010, intercalated with the nucleus 1030 and/or encapsulating the nucleus 1030 and the intermediate layer 1020.

Further embodiments, shown in FIG. 2, may comprise a number of additional layered macro-compositions as shown in FIG. 1, and 2010, 2020, 2030, all together being a plurality of layered macro-compositions; and a plurality of bonds

2040, 2050 each bonded to least two of the layered macro-compositions 2010, 2020, 2030, such that each of the macro-compositions is bonded to at least one other of the macro-compositions by a bond. The bonds 2040, 2050 may be members of the group comprising ionic bonds, van der Waals bonds, dipolar bonds, covalent bonds, and other bonds. Alternatively, the bonds 2040, 2050 may comprise a component of another material to which a plurality of the basic layered macro-compositions 2010, 2020, 2030 are intercalated. The other material of the bonds may be, for example, a member of the group consisting of grease, lithium complex grease, oil, hydrocarbons, polytetrafluoretyhylene, plastic, gel, wax, silicone, hydrocarbon oil, vegetable oil, corn oil, peanut oil, canola oil, soybean oil, mineral oil, paraffin oil, synthetic oil, petroleum gel, petroleum grease, hydrocarbon gel, hydrocarbon grease, lithium based grease, fluoroether based grease, ethylenebistearamide, and combinations thereof.

In embodiments the bonds 2040, 2050 between the layered nanoparticles 2010, 2020, 2030 may be made by blending together the nanoparticles 2010, 2020, 2010 either alone or in a medium. In the case where the bonds are made by the nanoparticles intercalating with components of another material such as grease and oil, then the bonds are made by the nanoparticles being blended with the other material.

The blending may be done by a mechanical blender. For example, in one embodiment when the nanoparticles are bonded to components of a lithium complex grease, nanoparticle additive may be added to the lithium complex grease to the extent of about 3% to 6% by weight of the total mixture. The mixture is then blended with a mechanical blender, causing the nanoparticles 2010, 2020, 2030 to bond to components of the lithium complex grease.

Figure 3A:
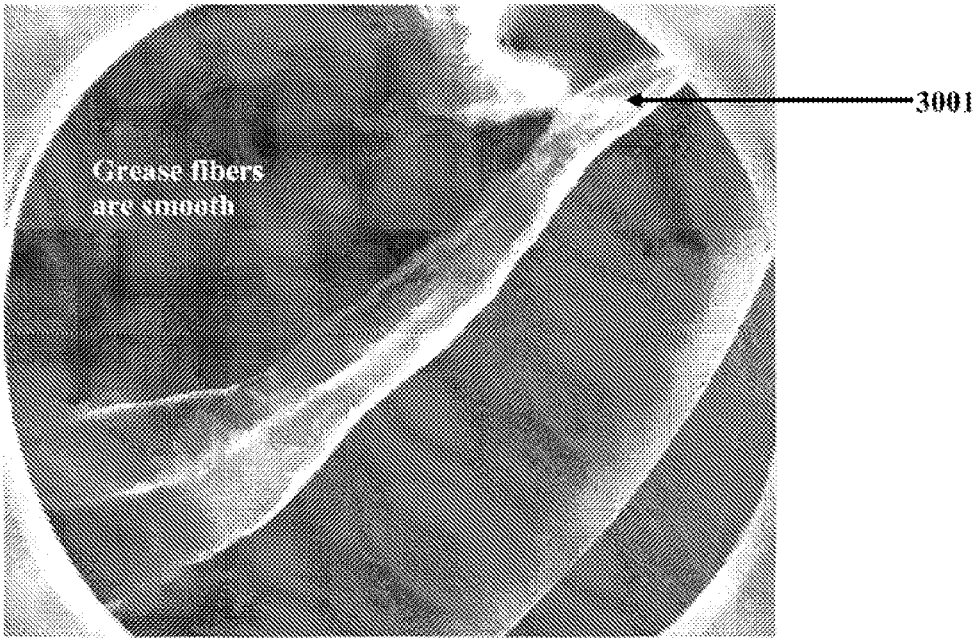
FIG. 3A is a scanning electron microscopy (SEM) image of grease fibers in an as-received condition before a nanoparticle macro-composition is bonded to the grease fibers.
Figure 3B:
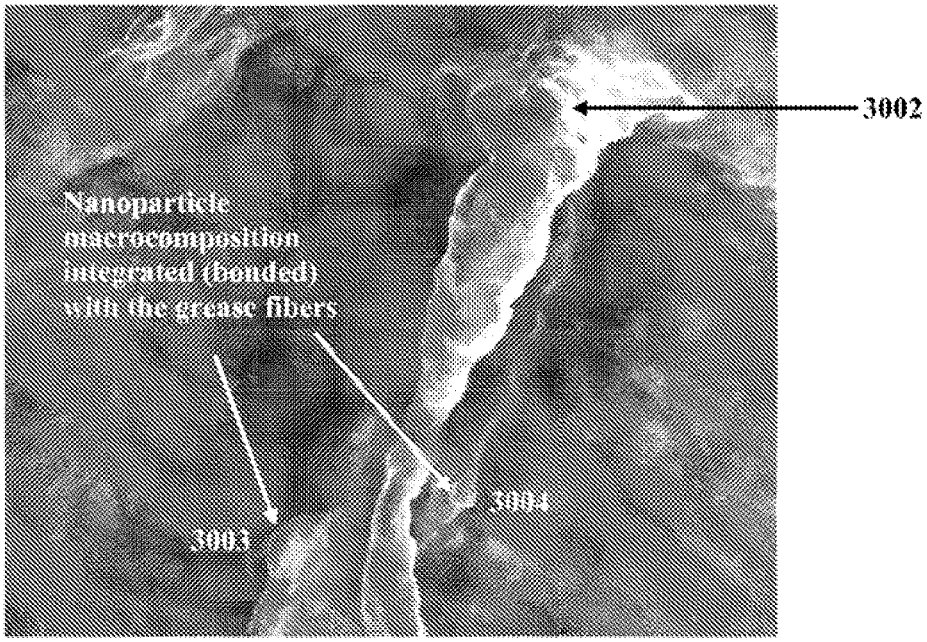
FIG. 3B is a SEM image of grease fibers after bonding with a nanoparticle macro-composition.

For example, see FIG. 3. FIG. 3 shows scanning electron microscopy ("SEM") images of grease fibers before and after macro-composition nanoparticle embodiments are bonded to the grease fibers. FIG. 3(*a*) shows prior art grease as received from the vendor. The grease fiber 3001 is smooth in the SEM image in FIG. 3(*a*) and no macro-composition nanoparticles are shown associated with it. FIG. 3(*b*) shows the grease fiber 3002, 2040 after embodiments of the macro-composition nanoparticle additive of the present invention have been added to the grease, and the additive particles 3003, 3004, 2010, 2020 have bonded to the grease fiber 3002, 2040 by intercalation or otherwise. The grease fiber 3002, 2040 appears lumpy in the image with each 2010, 2020, 3003, 3004 lump (pointed to by the two arrows) being a macro-composition nanoparticle bonded (or integrated), with the grease fiber by 3002, 2040 intercalation or otherwise. The image of FIG. 3(*b*) with grease fiber 3002, 2040 bonded to nanoparticle macro-composition additives 3003, 3004, 2010, 2020 then shows an embodiment of FIG. 2 showing the macro-composition 2010, 2020, with bonds 2040, where the bond 2040 is a component of another material such as grease 3002.

In various embodiments, the mechanical blending may take place for about two to 24 hours. Mechanical blending is generally executed until there is no agglomeration of the nanoparticles. In other embodiments, mechanical blending may be executed until performance testing indicates that desired bonding has been achieved. It is a goal of the blending to have a very well-dispersed nanoparticle additive with no agglomeration.

A method to encourage the bonding of nanoparticles in various embodiments may include adding functional groups 1020 to the nanoparticles. These functional groups may be selected in part to bond with each other and thereby bond their respective nanoparticles 2010. These functional groups 1020 may be radicals molecularly bonded to molecules of one or more layers 1010, 1020, 1030 of the nanoparticles, or the functional groups may be the intermediate layer 1020 of the nanoparticle that might tend to bond with other nanoparticles.

In various embodiments the bonds 2040, may be between a nanoparticle 2010 and surrounding oil. If there is no such bond then the nanoparticle may settle out in the oil and not remain dispersed in the oil. Bonding of the nanoparticle throughout the surrounding oil may promote dispersion of the nanoparticle in the oil.

The bond between a nanoparticle and the surrounding oil or grease can be a polar bond (or dipolar bond, as they are sometimes called), and may prevent the nanoparticle from settling out in the oil.

The bonds between the nanoparticle and surrounding grease, in some embodiments, may be an intercalation of the nanoparticle to components of the grease. Alternatively, the nanoparticle may be bonded to the grease component according to the other types of bonds.

The intermediate layer 1020 of the nanoparticles 2010 may be formed by mixing and blending two layered nanoparticles with the inner core 1010 and the outer layer 1030, with no intermediate layer 1020, with the material of the intermediate layer. Then by blending and mixing the nanoparticles with the material of the intermediate layer, the material of the intermediate layer may become mechanically associated with the nanoparticle between the outer layer 1030 and the inner layer 1010, or bonded or intercalated with the material of the core 1010 or the outer layer 1030. This blending and mixing in some embodiments may be executed until the performance of the nanoparticles indicates that the intermediate layer 1020 has successfully been formed.

The inner nucleus 1030 may have an open architecture. Open architecture is often used to refer to a structure of the inner nucleus 1030 that facilitates intercalation of organic or other molecules within the atomic planes or crystalline structure of the inner nucleus. For example, the ends of the atomic planes may be disturbed and made irregular, or fissures and cracks may be developed in the surface of the inner nucleus by milling or otherwise, to facilitate intercalation. Open architecture may also refer to the nucleus intercalated with the organic or other molecules, the intercalation itself being a key indication of open architecture of the nucleus.

The macro-composition 2010, 2020, 2030 may be no more than about 100 nanometers in size.

The bonds 2040, 2050 may have an average length of no more than about 100 nanometers.

The nucleus 1030 may be made of a material which is a member of the group consisting of for example chalcogenides, molybdenum disulphide, tungsten disulphide, graphite, boron nitride, polytetrafluoroethylene, hexagonal boron nitride, soft metals, silver, lead, nickel, copper, cerium fluoride, zinc oxide, silver sulfate, cadmium iodide, lead iodide, barium fluoride, tin sulfide, zinc phosphate, zinc sulfide, mica, boron nitrate, borax, fluorinated carbon, zinc phosphide, boron, and combinations thereof.

The intermediate layer 1020 may comprise a material which is a member of the group consisting of for example lecithins, phospholipids, phosphides, soy lecithins, detergents, glycerides, distilled monoglycerides, monoglycerides, diglycerides, acetic acid esters of monoglycerides, organic acid esters of monoglycerides, sorbitan esters of fatty acids, propylene glycol esters of fatty acids, polyglycerol esters of fatty acids, compounds containing phosphorous, compounds containing sulfur, compounds containing nitrogen, and combinations thereof.

The intermediate layer 1020 may comprise an anti-oxidant comprising at least one material selected from the group consisting of hindered phenols, alkylated phenols, alkyl amines, aryl amines, 2,6-di-tert-butyl-4-methylphenol, 4,4'-di-tert-octyldiphenylamine, tert-butyl hydroquinone, tris(2,4-di-tert-butylphenyl)phosphate, phosphites, thioesters, and combinations thereof.

The intermediate layer 1020 may comprise an anti-corrosion material comprising at least one material selected from the group consisting of alkaline earth metal bisalkylphenolsulphonates, dithiophosphates, alkenylsuccinic acid half-amides, and combinations thereof.

The outer layer 1010 may comprise one or more of the materials which are a member of the group consisting of oil, grease, alcohol, composite oil, canola oil, vegetable oils, soybean oil, corn oil, ethyl and methyl esters of rapeseed oil, glycerides, distilled monoglycerides, monoglycerides, diglycerides, acetic acid esters of monoglycerides, organic acid esters of monoglycerides, sorbitan, sorbitan esters of fatty acids, propylene glycol esters of fatty acids, polyglycerol esters of fatty acids, hydrocarbon oils, n-hexadecane, phospholipids, phosphides, and combinations thereof.

Embodiments of the present invention in FIG. 1, or FIG. 2, may be added to a volume of lubricant, in which the layered macro-compositions, whether bonded or not, are dispersed. The lubricant may comprise, for example, one or more of the group consisting of grease, oil, gear oil, lithium complex grease, and coatings.

Other embodiments of the present invention may comprise a plurality of nanoparticle inner nuclei 1030; on each nucleus 1030, an outer layer 1010 intercalated with the nucleus 1030 and/or encapsulating the nucleus 1030, the layer 1010 with the nucleus 1030 forming a two layered nanoparticle; and a plurality of bonds 2040, 2050, each bond bonded to at least two of the layered nanoparticles, such that each layered nanoparticle is bonded to at least one other of the layered nanoparticles by a bond.

The inner nuclei 1030 each may have an open architecture.

The bonds 2040, 2050 may be, for example, members of the group comprising ionic bonds, van der Waals bonds, dipolar bonds, covalent bond, and other bonds.

The bonds 2040, 2050 may comprise a component of another material to which a plurality of the two layered macroparticles are intercalated, where the other material of the bonds is, for example, a member of the group consisting of grease, lithium complex grease, oil, hydrocarbons, polytetrafluoretyhylene, plastic, gel, wax, silicone, hydrocarbon oil, vegetable oil, corn oil, peanut oil, canola oil, soybean oil, mineral oil, paraffin oil, synthetic oil, petroleum gel, petroleum grease, hydrocarbon gel, hydrocarbon grease, lithium based grease, fluoroether based grease, ethylenebistearamide, and combinations thereof.

Lubrication

Embodiments may be used in multiple industrial sectors such as, for example, non-renewable energy, gas-and-oil explorations, coatings for machine tools, environmentally sustainable additives for polymers, electronics, and others. Embodiments combine the power of functional lubrication properties, and the ability to integrate multiple lubricant chemistries (of typical solids and liquids) at nanoscale. Combinatorial chemical and mechanical nanomanufacturing processes allow embodiments to transform traditional lubricants into next generation lubricant additives. This may be a drop-in or additive composition that industries have sought for decades for harsh boundary and mix lubrication applications. Embodiments may be used for on-site, on-demand lubrication, for example under extreme pressure conditions typically encountered in the boundary regime. Embodiments offer a unique opportunity to equipment and lubricant designers to work with application specific formulation designs (FIG. 1) that can be tailored to best meet end application requirements and cost.

Embodiments may comprise a nano-architected macromolecular lubrication "delivery system." Embodiments may combine in mixed macromolecular form lubricant chemistries previously delivered only in solid or liquid forms (e.g., molybdenum disulfide, hexagonal boron nitride, graphite, zinc dialkyldithiophosphates, molybdenum dithiophosphates, succinimides, esters, molybdenum dialkyldithiocarbamate, zinc dialkyldithiocarbamate, and amides). Embodiments may integrate these chemistries in unique architectures as per application demands recommended by end users, in embodiments as additives to greases, oils, coatings, and other materials.

The size, chemistries and shapes of these macro-compositions allow them to navigate into intricate spaces between the asperities of lubricated surfaces, for example during boundary lubrication, when the liquid lubricants alone are pushed out and solid lubricants alone are clogged.

Embodiments, in one example, provide at least three lines of defenses against friction and wear, when nano-nuclei 1030 of tens of atomic planes of sulfides or other layer material integrated with functional shells 1020 of glycerides or other material encapsulated with polar phosphide molecules 1010 or other material come in contact with mating steel parts. (See FIG. 1). Three lines of defense are due to plastic deformation of the core nucleus 1030, and delivery of phosphides 1010 and formation of friction-polymers, a metastable material phase of combinatorial chemistries, as a result of thermochemical interactions around the asperities of mating lubricated surfaces. These embodiments of nano-delivery lubricant systems reside in intricate asperity surfaces ready to be delivered and react even under dry conditions, to alleviate friction under extreme conditions. For instance, in various embodiments, a macro-composition may localize into spaces between asperities of a lubricated surface, and wherein under frictional conditions, the inner nucleus 1030 may plastically deform, thereby forming a lubricating tribofilm between asperities of contacting surfaces. Embodiments are an effective platform technology to work with state of the art oils and greases from various suppliers to improve lubricity. Embodiments are effective in extending grease and oil performance by significant margins as described below in specific case studies on greases and oils provided by various suppliers. (See Table 1 and Table 2, below).

TABLE 1

| | Case Study 1 | | | | | |
|---|---|---|---|---|---|---|
| | ASTM D2266 4-Ball Test | | ASTM D2596 4-Ball EP Test | | | |
| LITHIUM-COMPLEX GREASES | Wear Scar Diameter (WSD) mm | COF | Load Wear Index (LWI) Kgs | Last Non-Seizure Load (LNSL) Load, Kg | Last Seizure Load (LSL) Load, Kg | Weld Load Kgs |
| Supplier-1: Li-Base Hi-Temp Base Grease | 0.6 | 0.116 | 51 | 80 | 315 | 400 |

TABLE 1-continued

| | Case Study 1 | | | | | |
|---|---|---|---|---|---|---|
| | ASTM D2266 4-Ball Test | | ASTM D2596 4-Ball EP Test | | | |
| LITHIUM-COMPLEX GREASES | Wear Scar Diameter (WSD) mm | COF | Load Wear Index (LWI) Kgs | Last Non-Seizure Load (LNSL) Load, Kg | Last Seizure Load (LSL) Load, Kg | Weld Load Kgs |
| Supplier-1: Li-Base Hi-Temp Base Grease + micron-size $MoS_2$ | 0.58 | 0.11 | 55 | 80 | 315 | 400 |
| Supplier-1: Li-Base Hi-Temp Base Grease + ZDDP | 0.58 | 0.113 | 48 | 63 | 315 | 400 |
| Supplier-1: Li-Base Hi-Temp Grease + embodiment of invention | 0.45 | 0.07 | 68 | 100 | 400 | 500 |
| Supplier-2 Moly EP Premium Grease | 0.12 | 0.72 | 33.3 | 50 | 200 | 250 |
| Supplier-2 Lithium Grease + embodiment of invention | 0.1 | 0.54 | 43.97 | 50 | 200 | 250 |

TABLE 2

| | Case Study 2 | | | | | |
|---|---|---|---|---|---|---|
| | ASTM D4172 4-Ball Test | | ASTM D2783 4-Ball EP Test | | | |
| GEAR OILS (Supplier-3) | Wear Scar Diameter (WSD) mm | COF | Load Wear Index (LWI) | Last Non-Seizure Load (LNSL) Load, Kg | Last Seizure Load (LSL) Load, Kg | Weld Load Kgs |
| Neat VG 32 Gear Oil | 0.75 | 0.129 | 21 | 80 | 100 | 126 |
| Neat VG 32 Gear Oil + embodiment of invention | 0.44 | 0.092 | 29 | 126 | 160 | 200 |
| Formulated VG 32 Gear Oil | 0.45 | 0.115 | 26 | 80 | 100 | 126 |
| Formulated VG 32 Gear Oil + embodiment of invention | 0.44 | 0.097 | 29 | 126 | 160 | 200 |
| Neat VG 150 Gear Oil | 0.45 | 0.109 | 41.56 | 100 | 160 | 200 |
| Neat VG 150 Gear Oil + embodiment of invention | 0.48 | 0.107 | 31.25 | 63 | 200 | 250 |
| Formulated VG 150 Gear Oil | 039 | 0.08 | 39.4 | 80 | 200 | 250 |
| Formulated VG 150 Gear Oil + embodiment of invention | 0.37 | 0.089 | 49.29 | 100 | 250 | 315 |
| Neat VG 320 Gear Oil | 0.44 | 0.108 | 28.77 | 63 | 160 | 200 |
| Neat VG 320 Gear Oil + embodiment of invention | 0.47 | 0.109 | 43.24 | 100 | 200 | 250 |

As shown in the examples reported in Table 1 and Table 2, the tribological performance of lubricants may be improved using macro-compositions in accordance with various embodiments. The tribological performance may be measured by evaluating different properties in accordance with the following standard testing procedures, which are each incorporated by reference into this specification in their entirety:

ASTM D2266—2001: Standard Test Method for Wear Preventive Characteristics of Lubricating Grease (Four-Ball Method);

ASTM D2596—2002: Standard Test Method for Measurement of Extreme-Pressure Properties of Lubricating Grease (Four-Ball Method);

ASTM D4172—94 (2004): Standard Test Method for Wear Preventive Characteristics of Lubricating Fluid (Four-Ball Method); and ASTM D2783—2003: Standard Test Method for Measurement of Extreme-Pressure Properties of Lubricating Fluids (Four-Ball Method).

Figure 5:
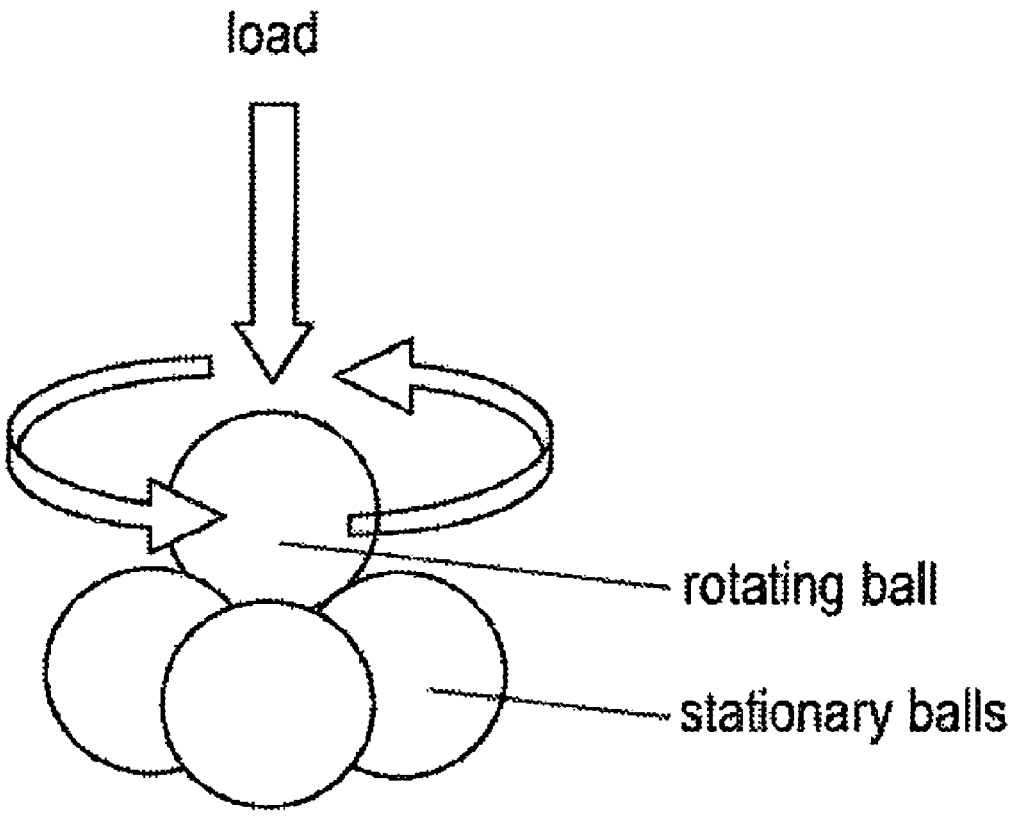
FIG. 5 is a schematic diagram showing the setup of a 4-ball wear test in accordance with ASTM D2266 or ASTM D2596.

Anti-wear properties may include lubricating fluid properties that have been measured using the industry standard Four-Ball Method in accordance with the above-incorporated standard tests. The Four-Ball Method may evaluate the protection provided by a lubricating composition under conditions of pressure and sliding motion. Placed in a bath of the test lubricant, three fixed and stationary steel balls may be put into contact with a fourth ball of the same grade under load and in rotating contact at preset test conditions (see FIG. 5). Lubricant wear protection properties may be measured by comparing the average wear scars on the three fixed balls (ASTM D2266 and ASTM D4172). The smaller the average wear scar, the better the protection.

Extreme pressure properties include lubricating fluid properties that have been measured using the industry standard Four Ball Method in accordance with the above-incorporated standard tests. These test methods (ASTM D2596 and ASTM D2783) may cover the determination of the load-carrying properties of lubricating fluids. The following determinations may be made: (1) load-wear index (LWI, formerly Mean-Hertz load); (2) last non-seizure load (LNSL); (3) last seizure load (LSL); and (4) weld load.

The load-wear index may be the load-carrying property of a lubricant. It may be an index of the ability of a lubricant to minimize wear at applied loads. The last non-seizure load may be the last load at which the measured scar diameter is not more than 5% above the compensation line at the load and indicates the transition from elastohydrodynamic lubrication to boundary lubrication and metal to metal contact. The last seizure load may be the last load achieved before ball-to-ball seizure, i.e., asperity welding. The weld load may be the lowest applied load in kilograms at which the rotating ball welds to the three stationary balls, indicating the extreme pressure level that the lubricants can withstand. The higher the weld point scores and load wear index values, the better the anti-wear and extreme pressure properties of a lubricant.

The coefficient of friction (COF) may be a lubricating fluid property that has been measured using the Four Ball Method in accordance with the above-incorporated standard tests. COF may be a dimensionless scalar value which describes the ratio of the force of friction between two bodies and the force pressing them together. The coefficient of friction may depend on the materials used. For example, ice on metal has a low COF, while rubber on pavement has a high COF. A common way to reduce friction may be by using a lubricant, such as oil or water, which is placed between two surfaces, often dramatically lessening the COF.

Referring to Tables 1 and 2, it is evident that the addition of macro-compositions as described herein to lubricating greases and oils significantly improves the lubrication performance of these compositions by reducing the measured wear scar diameters and coefficients of friction in industry standard testing. The addition of macro-compositions as described herein to lubricating greases and oils also significantly improves the extreme pressure properties of these compositions by increasing the measured load-wear indices, last non-seizure loads, last seizure loads, and weld loads in industry standard testing.

Figure 4:
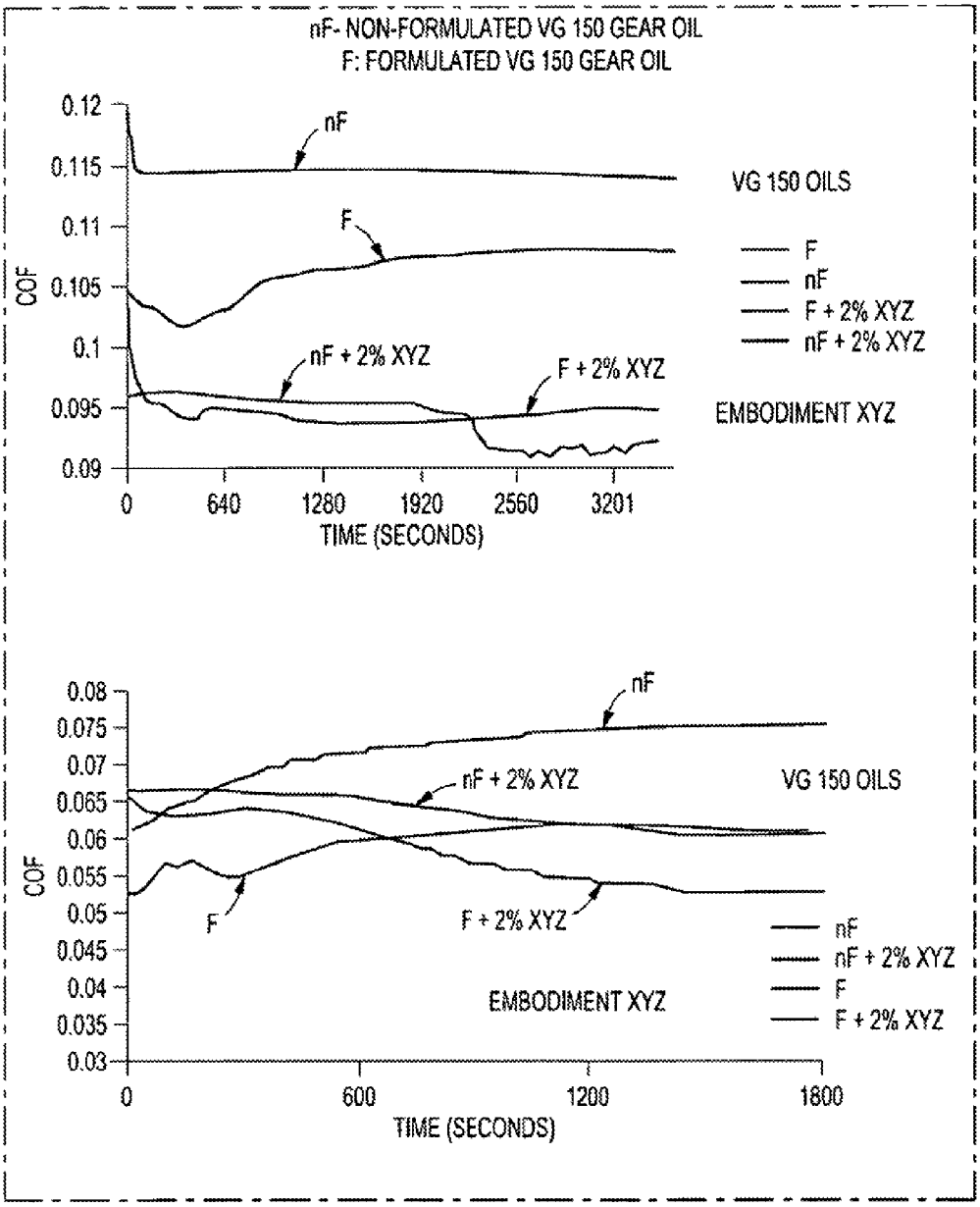
FIG. 4 shows pin-on-disc test results (top graph), and block-on-ring test results (bottom graph) for embodiments added to formulated and non-formulated oils.

To demonstrate the efficiency of embodiments under different contact conditions, loads, and speeds, embodiments were tested on two industry standard tribometers, namely block-on-ring and pin-on-disc. Drastic reductions in coefficient of friction (COF) on the pin-on-disc test, 17.5% over the base non-formulated oil and 11% over the base formulated oils, are observed proving the compatibility of embodiments in current gear oil packages (see FIG. 4, left graph). Under severe sliding conditions (area contact) on the block-on-ring test, embodiments reduce the COF of non-formulated VG150 oil by 11% and of formulated oil by 3% (see FIG. 4, right graph).

Thus, embodiments provide drop-in additive solutions to alleviate friction and wear characteristics to bring about cost-performance benefits through the selection of precise nano-chemistries and their ability to perform under critical load, temperature, speed, duration, and contact conditions. As evident from the data in FIG. 4 and Tables 1 and 2, embodiments include a drop-in product or additive composition to traditional off-the-shelf greases and oils with no threshold time to impart superior anti-wear and extreme pressure characteristics to lithium-complex greases and gear oils, for example. Lithium-complex greases constitute 40% of the entire grease market in U.S., Canada, and Mexico.

Additionally, embodiments allow simultaneous provision of multiple functions, such as anti-wear, extreme pressure, and anti-corrosion. This distinguishes the present invention from other organic and inorganic lubricant additives. This factor simplifies inventory and record-keeping, and also eases calculation of users and formulators, thus increasing control and saving time. From an anti-wear/extreme pressure additive to oils/greases to metalworking and drilling fluids, embodiments have diversity in end-application, impacting industries even beyond tribology and lubrication, such as sustainable metal working Embodiments are an economical, fill for life drop-in additive platform for oils, greases and coatings that can enhance components' durability and save energy.

Layered Nanoparticle Macro-Compositions

Knowledge that may be useful to practice some aspects of some embodiments of the claimed invention, may be found in pending U.S. patent application Ser. No. 12/160,758 (U.S. Publication No. 2008/0312111 A1), for "Nanoparticle Compositions and Methods for Making and Using the Same" by Malshe et al., which is incorporated by reference into this specification in its entirety.

Embodiments of layered nanoparticle macro-compositions may include solid lubricant nanoparticles and an organic medium, and nanoparticles of layered materials. Layered nanoparticle macro-compositions may be made by milling layered materials. A lubricant may be made by milling layered materials to form nanoparticles and incorporating the nanoparticles into a base to form a lubricant. This knowledge may be useful in making some embodiments of the macro-compositions shown in FIG. 1, and 2010, 2020, 2030.

Some embodiments may be made as compositions comprising solid lubricant nanoparticles and an organic medium, and some with nanoparticles comprising layered materials. The nanoparticles may be solid lubricant nanoparticles. The nanoparticles may be made from starting materials or solid lubricant starting materials. Examples of solid lubricants may include, but are not limited to, layered materials, suitably chalcogenides, more suitably, molybdenum disulphide, tungsten disulphide, or a combination thereof. Another suitable layered material is graphite or intercalated graphite. Other solid lubricants that may be used alone or in combination with the layered materials are polytetratluoroethylene (Teflon®), boron nitride (suitably hexagonal boron nitride), soft metals (such as silver, lead, nickel, copper), cerium fluoride, zinc oxide, silver sulfate, cadmium iodide, lead iodide, barium fluoride, tin sulfide, zinc phosphate, zinc sulfide, mica, boron nitrate, borax, fluorinated carbon, zinc phosphide, boron, or a combination thereof. Fluorinated carbons may be, without limitation, carbon-based materials such as graphite which has been fluorinated to improve its aesthetic characteristics. Such materials may include, for example, a material such as $CF_x$ wherein x ranges from about 0.05 to about 1.2. Such a material is produced by Allied Chemical under the trade name Accufluor.

Some embodiments of methods may include milling a solid lubricant feed. In one embodiment, the solid lubricant feed may be capable of being milled to particles comprising an average dimension of about 500 nanometers (submicron size) to about 10 nanometers. Suitably, the particles may have an average particle dimension of less than or equal to about 500 nanometers, suitably less than or equal to about 100 nanometers, suitably less than or equal to about 80 nanometers, suitably less than or equal to about 50 nanometers, and more suitably less than or equal to about 20 nanometers. Alternatively, the milling may result in milled solid lubricant particles comprising a mixture, the mixture comprising particles having an average particle dimension of less than or equal to about 500 nanometers, plus larger particles. Milling may include, among other things, ball milling and chemo mechanical milling. Examples of ball milling may include dry ball milling, wet ball milling, and combinations thereof. Ball milling may refer to an impaction process that may include two interacting objects where one object may be a ball, a rod, 4 pointed pins (Jack shape), or other shapes. Chemo mechanical milling may refer to an impaction process that may form a complex between an organic medium and a nanoparticle. As a result of chemo mechanical milling, the organic medium may coat, encapsulate, and/or intercalate the nanoparticles.

In another embodiment, the solid lubricant feed may be dry milled and then wet milled. An emulsifier may be mixed with a base and added to the wet milled particles. Dry milling may refer to particles that have been milled in the presence of a vacuum, a gas, or a combination thereof. Wet milling may refer to particles that have been milled in the presence of a liquid.

The solid lubricant nanoparticle composition may further comprise an organic medium. Examples of organic mediums include, but are not limited to, oil mediums, grease mediums, alcohol mediums, or combinations thereof. Specific examples of organic mediums include, but are not limited to, composite oil, canola oil, vegetable oils, soybean oil, corn oil, ethyl and methyl esters of rapeseed oil, distilled monoglycerides, monoglycerides, diglycerides, acetic acid esters of monoglycerides, organic acid esters of monoglycerides, sorbitan, sorbitan esters of fatty acids, propylene glycol esters of fatty acids, polyglycerol esters of fatty acids, n-hexadecane, hydrocarbon oils, phospholipids, or a combination thereof. Many of these organic media may be environmentally acceptable.

The composition may contain emulsifiers, surfactants, or dispersants. Examples of emulsifiers may include, but are not limited to, emulsifiers having a hydrophilic-lipophilic balance (HLB) from about 2 to about 7; alternatively, a HLB from about 3 to about 5; or alternatively, a HLB of about 4. Other examples of emulsifiers may include, but are not limited to, lecithins, soy lecithins, phospholipids, lecithins, detergents, distilled monoglycerides, monoglycerides, diglycerides, acetic acid esters of monoglycerides, organic acid esters of monoglycerides, sorbitan esters of fatty acids, propylene glycol esters of fatty acids, polyglycerol esters of fatty acids, compounds containing phosphorous, compounds containing sulfur, compounds containing nitrogen, or a combination thereof.

A method of making a lubricant is described. The composition may be used as an additive dispersed in a base. Examples of bases may include, but are not limited to, oils, greases, plastics, gels, sprays, or a combination thereof. Specific examples of bases may include, but are not limited to, hydrocarbon oils, vegetable oils, corn oil, peanut oil, canola oil, soybean oil, mineral oil, paraffin oils, synthetic oils, petroleum gels, petroleum greases, hydrocarbon gels, hydrocarbon greases, lithium based greases, fluoroether based greases, ethylenebistearamide, waxes, silicones, or a combination thereof.

Described herein is a method of lubricating or coating an object that is part of an end application with a composition comprising at least one of solid lubricant nanoparticles and an organic medium. Further described is a method of lubricating an object by employing the composition comprising solid lubricant nanoparticles and an organic medium as a delivery mechanism.

Disclosed herein are compositions and methods of preparing nanoparticle based lubricants that, among various advantages, display enhanced dispersion stability and resistance to agglomeration. A solid lubricant feed may be introduced via a line to a ball milling processor. Ball milling may be carried out in the processor and the solid lubricant feed may be milled to comprise particles having an average particle dimension of less than or equal to about 500 nanometers, suitably less than or equal to about 100 nanometers, suitably less than or equal to about 80 nanometers, suitably less than or equal to about 50 nanometers, and more suitably less than or equal to about 20 nanometers. Alternatively, the ball milling may result in milled solid lubricant particles comprising a mixture, the mixture comprising particles having an average particle dimension of less than or equal to about 500 nanometers, plus larger particles. The ball milling may be high energy ball milling, medium energy ball milling, or combinations thereof. Additionally, in various embodiments the ball milling may be carried out in a vacuum, in the presence of a gas, in the presence of a liquid, in the presence of a second solid, or combinations thereof. The nanoparticle composition may be removed from a processor via a line. The nanoparticle composition may be a nanoparticle based lubricant.

In alternative embodiments, ball milling may comprise a first ball milling and at least one more subsequent ball millings, or ball milling and/or other processing as appropriate. Suitably, the ball milling may comprise dry milling followed by wet milling. A feed line may introduce a solid lubricant feed into a ball milling processor where dry ball milling, such as in a vacuum or in air, reduces the solid lubricant feed to particles having an average dimension of the size described above. A line may carry the dry milled particles to a wet milling processor. A line may combine the dry milled particles with a composite oil or an organic medium prior to entering the wet milling processor. Alternatively, the organic medium and dry milled particles may be combined in the wet milling processor. In further alternative embodiments, the dry milling and wet milling may be carried out in a single processor where the organic medium is supplied to the single processor for wet milling after initially carrying out dry milling. In other alternative embodiments, the balls in the ball milling apparatus may be coated with the organic medium to incorporate the organic medium in the solid lubricant nanoparticles.

After wet milling, a line may carry the wet milled particles to a container, which may be a sonication device. Alternatively, a line may carry a mixture comprising solid lubricant nanoparticles, organic medium, and a complex comprising the solid lubricant nanoparticles combined with an organic medium.

In another embodiment, prior to introduction of the wet milled particles into a container, a base may be fed to the container via a line. Alternatively, the base may be supplied to a wet milling processor and the mixing, which may include sonicating, may be carried out in the wet milling processor. In such embodiments the solid lubricant nanoparticle composition may be employed as an additive and dispersed in the base. A base may be paired with a solid lubricant nanoparticle composition according to the ability of the base and the solid lubricant nanoparticle composition to blend appropriately. In such cases the solid lubricant nanoparticle composition may enhance performance of the base.

In a further embodiment, an emulsifier may be mixed with the base. Emulsifiers may further enhance dispersion of the solid lubricant nanoparticle composition in the base. The emulsifier may be selected to enhance the dispersion stability of a nanoparticle composition in a base. An emulsifier may also be supplied to a container via a line. In many embodiments, the emulsifier and base are combined in a container prior to introduction of wet milled particles. Prior mixing of the emulsifier with the base may enhance dispersion upon addition of complexes of solid lubricant nanoparticles and organic medium and/or solid lubricant nanoparticles by homogeneously dispersing/dissolving the complexes/nanoparticles. In some embodiments, the mixing of the emulsifier and base may comprise sonicating. Alternatively, the emulsifier may be supplied to a wet milling processor and the mixing, which may include sonicating, may be carried out in the wet milling processor. The lubricant removed from a container via a line may be a blend comprising the wet milled particles, organic medium, and base. The blend may further comprise an emulsifier. In other alternative embodiments, additives may be added to the nanoparticle based lubricant during interaction with a mating surface.

In a further embodiment, antioxidants or anticorrosion agents may be milled with the solid lubricant nanoparticles. Examples of antioxidants include, but are not limited to, hindered phenols, alkylated phenols, alkyl amines, aryl amines, 2,6-di-tert-butyl-4-methylphenol, 4,4'-di-tertoctyldiphenylamine, tert-butyl hydroquinone, tris(2,4-di-tert-butylphenyl)phosphate, phosphites, thioesters, or a combination thereof. Examples of anticorrosion agents include, but are not limited to, alkaline-earth metal bisalkylphenolsulphonates, dithiophosphates, alkenylsuccinic acid half-amides, or a combination thereof. In another embodiment, biocidals may be milled with the solid lubricant nanoparticles. Examples of biocidals may include, but are not limited to, alkyl or kydroxylamine benzotriazole, an amine salt of a partial alkyl ester of an alkyl, alkenyl succinic acid, or a combination thereof.

In yet another embodiment, further processing of wet milled particles may comprise removal of oils that are not a part of a complex with the solid lubricant particles. Such methods may be suitable for applications that benefit from use of dry particles of solid lubricant, such as coating applications. Oil and/or other liquids can be removed from wet milled particles to produce substantially dry solid lubricant particles and complexes. Such wet milling followed by drying may produce a solid lubricant with reduced tendency to agglomerate. In specific embodiments, an agent, such as acetone, can be added that dissolves oils that are not a part of a complex, followed by a drying process such as supercritical drying, to produce a substantially dry solid lubricant comprising particles treated by milling in an organic medium.

Ball milling conditions may vary and, in particular, conditions such as temperature, milling time, and size and materials of the balls and vials may be manipulated. In various embodiments, ball milling may be carried out from about 12 hours to about 50 hours, suitably from about 36 hours to about 50 hours, suitably from about 40 hours to about 50 hours, and more suitably at about 48 hours. Suitably, ball milling is conducted at room temperature. The benefits of increasing milling time may comprise at least one of increasing the time for the organic medium and solid lubricant nanoparticles to interact; and producing finer sizes, better yield of nanoparticles, more uniform shapes, and more passive surfaces. An example of ball milling equipment suitable for carrying out the described milling includes the SPEX CertiPrep model 8000D, along with hardened stainless steel vials and hardened stainless steel grinding balls, but any type of ball milling apparatus may be used. In one embodiment, a stress of 600-650 MPa, a load of 14.9 N, and a strain of $10^{-3}$-$10^{-4}$ per sec may be used.

The proportions of the components in a nanoparticle based lubricant may contribute to performance of the lubricant, such as the lubricants dispersion stability and ability to resist agglomeration. In wet milling, suitable ratios of solid lubricant nanoparticles to organic medium may be about 1 part particles to about 4 parts organic medium by weight, suitably, about 1 part particles to about 3 parts organic medium by weight, suitably, about 3 parts particles to about 8 parts organic medium by weight, suitably, about 2 parts particles to about 4 parts organic medium by weight, suitably, about 1 part particles to about 2 parts organic medium by weight, and suitably, about 1 part particles to about 1.5 parts organic medium by weight.

Suitable ratios of organic medium to emulsifier in a lubricant including the solid lubricant nanoparticles may be about 1 part organic medium to less than or equal to about 1 part emulsifier, suitably, about 1 part organic medium to about 0.5 parts emulsifier by weight, or suitably, from about 0.4 to about 1 part emulsifier for about 1 part organic medium by weight.

The amount of solid lubricant nanoparticle composition (by weight) sonicated or dispersed in the base may be from about 0.25% to about 5%, suitably 0.5% to about 3%, suitably 0.5% to about 2%, and more suitably 0.75% to about 2%.

The amount of emulsifier (by weight) sonicated or dissolved in the base, depending on the end application, shelf-life, and the like, may be from about 0.5% to about 10%, suitably from about 4% to about 8%, suitably from about 5% to about 6%, and suitably, from about 0.75% to about 2.25%.

The solid lubricant nanoparticle composition may be used, without limitation, as lubricants, coatings, delivery mechanisms, or a combination thereof. The solid lubricant nanoparticle composition may be used, without limitation, as an additive dispersed in a base oil. The composition may also be used, without limitation, to lubricate a boundary lubrication regime. A boundary lubrication regime may be a lubrication regime where the average oil film thickness may be less than the composite surface roughness and the surface asperities may come into contact with each other under relative motion. During the relative motion of two surfaces with lubricants in various applications, three different lubrication stages may occur, and the boundary lubrication regime may be the most severe condition in terms of temperature, pressure and speed. Mating parts may be exposed to severe contact conditions of high load, low velocity, extreme pressure (for example, 1-2 OPa), and high local temperature (for example, 150-300° C.). The boundary lubrication regime may also exist under lower pressures and low sliding velocities or high temperatures. In the boundary lubrication regime, the mating surfaces may be in direct physical contact. The composition may further be used, without limitation, as a lubricant or coating in machinery applications, manufacturing applications, mining applications, aerospace applications, automotive applications, pharmaceutical applications, medical applications, dental applications, cosmetic applications, food product applications, nutritional applications, health related applications, bio-fuel applications or a combination thereof. Specific examples of uses in end applications include, without limitation, machine tools, bearings, gears, camshafts, pumps, transmissions, piston rings, engines, power generators, pin-joints, aerospace systems, mining equipment, manufacturing equipment, or a combination thereof. Further specific examples of uses may be, without limitation, as an additive in lubricants, greases, gels, compounded plastic parts, pastes, powders, emulsions, dispersions, or combinations thereof. The composition may also be used as a lubricant that employs the solid lubricant nanoparticle composition as a delivery mechanism in pharmaceutical applications, medical applications, dental applications, cosmetic applications, food product applications, nutritional applications, health related applications, bio-fuel applications, or a combination thereof. The various compositions and methods may also be used, without limitation, in hybrid inorganic-organic materials. Examples of applications using inorganic-organic materials, include, but are not limited to, optics, electronics, ionics, mechanics, energy, environment, biology, medicine, smart membranes, separation devices, functional smart coatings, photovoltaic and fuel cells, photocatalysts, new catalysts, sensors, smart microelectronics, micro-optical and photonic components and systems for nanophotonics, innovative cosmetics, intelligent therapeutic vectors that combined targeting, imaging, therapy, and controlled release of active molecules, and nanoceramic-polymer composites for the automobile or packaging industries.

In some embodiments, a ball milling process may create a close caged dense oval shaped architecture (similar to a football shape or fullerene type architecture). This may occur when molybdenum disulphide or other layered solid lubricant material is milled in a gas or vacuum. In other embodiments, the ball milling process may create an open ended oval shaped architecture (similar to a hollow coconut shape) of molybdenum disulphide or other layered solid lubricant nanoparticles which are intercalated and/or encapsulated with an organic medium and/or phospholipids. This may occur when molybdenum disulphide or other layered solid lubricant is milled in a gas or vacuum followed by milling in an organic medium.

It is to be understood that the invention is not limited in its application to the details of construction and the arrangement of components set forth in the description or illustrated in the drawings herein. The invention is capable of other embodiments and of being practiced or of being carried out in various ways. Also, it is to be understood that the phraseology and terminology used herein is for the purpose of description and should not be regarded as limiting.

Any numerical range recited herein includes all values from the lower value to the upper value. For example, if a concentration range is stated as 1% to 50%, it is intended that values such as 2% to 40%, 10% to 30%, or 1% to 3%, etc., are expressly enumerated in this specification. These are only examples of what is specifically intended, and all possible combinations of numerical values between and including the lowest value and the highest value enumerated are to be considered to be expressly stated in this application.

The invention claimed is:

1. A macro-composition, the macro-composition comprising:

a layered nanoparticle macro-composition comprising
- a nanoparticle inner nucleus,
- an intermediate layer comprising a functional layered shell around the nucleus, and
- an outer layer intercalated with the nucleus or encapsulating the nucleus and the intermediate layer,
- wherein the inner nucleus has an open architecture.

2. The macro-composition of claim 1, further comprising:

a number of additional layered macro-compositions, all together being a plurality of layered macro-compositions; and a plurality of bonds each bonded to least two of the layered macro-compositions, such that each of the macro-compositions is bonded to at least one other of the macro-compositions by a bond.

3. The macro-composition of claim 2, wherein the bonds are members of the group comprising ionic bonds, van der Waals bonds, dipolar bonds, and covalent bonds.

4. The macro-composition in claim 2, wherein the bonds comprise a component of another material to which a plurality of the layered macro-compositions are intercalated.

5. The macro-composition of claim 4, wherein the other material of the bonds is a member of the group consisting of grease, lithium complex grease, oil, hydrocarbons, polytetrafluoretyhylene, plastic, gel, wax, silicone, hydrocarbon oil, vegetable oil, corn oil, peanut oil, canola oil, soybean oil, mineral oil, paraffin oil, synthetic oil, petroleum gel, petroleum grease, hydrocarbon gel, hydrocarbon grease, lithium based grease, fluoroether based grease, ethylenebistearamide, and combinations thereof.

6. The macro-composition in claim 1, wherein the macro-composition is no more than about 100 nanometers in size.

7. The macro-composition in claim 2, wherein the bonds have an average length of no more than about 100 nanometers.

8. The macro-composition of claim 1, wherein the nucleus comprises a material which is a member of the group consisting of chalcogenides, molybdenum disulphide, tungsten disulphide, graphite, boron nitride, polytetrafluoroethylene, hexagonal boron nitride, soft metals, silver, lead, nickel, copper, cerium fluoride, zinc oxide, silver sulfate, cadmium iodide, lead iodide, barium fluoride, tin sulfide, zinc phosphate, zinc sulfide, mica, boron nitrate, borax, fluorinated carbon, zinc phosphide, boron and combinations thereof.

9. The macro-composition of claim 1, wherein the functional layered shell comprises a material selected from lecithins, phospholipids, soy lecithins, detergents, distilled monoglycerides, monoglycerides, diglycerides, acetic acid esters of monoglycerides, organic acid esters of monoglycerides, sorbitan esters of fatty acids, propylene glycol esters of fatty acids, polyglycerol esters of fatty acids, compounds containing phosphorous, compounds containing sulfur, compounds containing nitrogen, and combinations thereof.

10. The macro-composition of claim 1, wherein the functional layered shell comprises an anti-oxidant comprising at least one material selected from the group consisting of hindered phenols, alkylated phenols, alkyl amines, aryl amines, 2,6-di-tert-butyl-4-methylphenol, 4,4'-di-tert-octyldiphenylamine, tert-butyl hydroquinone, tris(2,4-di-tert-butylphenyl) phosphate, phosphites, thioesters, and combinations thereof.

11. The macro-composition of claim 1, wherein the functional layered shell comprises an anti-corrosion material comprising at least one material selected from the group consisting of alkaline earth metal bisalkylphenolsulphonates, dithiophosphates, alkenylsuccinic acid half-amides, and combinations thereof.

12. The macro-composition of claim 1, wherein the outer layer comprises one or more materials which are a member of the group consisting of oil, grease, alcohol, composite oil, canola oil, vegetable oils, soybean oil, corn oil, ethyl and methyl esters of rapeseed oil, distilled monoglycerides, monoglycerides, diglycerides, acetic acid esters of monoglycerides, organic acid esters of monoglycerides, sorbitan, sorbitan esters of fatty acids, propylene glycol esters of fatty acids, polyglycerol esters of fatty acids, hydrocarbon oils, n-hexadecane, phospholipids, and combinations thereof.

13. A macro-composition, the macro-composition comprising:

a layered nanoparticle macro-composition comprising
- a nanoparticle inner nucleus,
- an intermediate layer around the nucleus, and
- an active capping layer intercalated with the nucleus or encapsulating the nucleus and the intermediate layer,
- wherein the inner nucleus has an open architecture.

14. The macro-composition of claim 13, further comprising:

a number of additional layered macro-compositions, all together being a plurality of layered macro-compositions; and a plurality of bonds each bonded to least two of the layered macro-compositions, such that each of the macro-compositions is bonded to at least one other of the macro-compositions by a bond.

15. The macro-composition of claim 14, wherein the bonds are members of the group comprising ionic bonds, van der Waals bonds, dipolar bonds, and covalent bonds.

16. The macro-composition in claim 14, wherein the bonds comprise a component of another material to which a plurality of the layered macro-compositions are intercalated.

17. The macro-composition of claim 16, wherein the other material of the bonds is a member of the group consisting of grease, lithium complex grease, oil, hydrocarbons, polytetrafluoretyhylene, plastic, gel, wax, silicone, hydrocarbon oil, vegetable oil, corn oil, peanut oil, canola oil, soybean oil, mineral oil, paraffin oil, synthetic oil, petroleum gel, petroleum grease, hydrocarbon gel, hydrocarbon grease, lithium based grease, fluoroether based grease, ethylenebistearamide, and combinations thereof.

18. The macro-composition in claim 13, wherein the macro-composition is no more than about 100 nanometers in size.

19. The macro-composition in claim 14, wherein the bonds have an average length of no more than about 100 nanometers.

20. The macro-composition of claim 13, wherein the nucleus comprises a material which is a member of the group consisting of chalcogenides, molybdenum disulphide, tungsten disulphide, graphite, boron nitride, polytetrafluoroethylene, hexagonal boron nitride, soft metals, silver, lead, nickel, copper, cerium fluoride, zinc oxide, silver sulfate, cadmium iodide, lead iodide, barium fluoride, tin sulfide, zinc phosphate, zinc sulfide, mica, boron nitrate, borax, fluorinated carbon, zinc phosphide, boron and combinations thereof.

21. The macro-composition of claim 13, wherein the intermediate layer comprises a material selected from lecithins, phospholipids, soy lecithins, detergents, distilled monoglycerides, monoglycerides, diglycerides, acetic acid esters of monoglycerides, organic acid esters of monoglycerides, sorbitan esters of fatty acids, propylene glycol esters of fatty acids, polyglycerol esters of fatty acids, compounds containing phosphorous, compounds containing sulfur, compounds containing nitrogen, and combinations thereof.

22. The macro-composition of claim 13, wherein the intermediate layer comprises an anti-oxidant comprising at least one material selected from the group consisting of hindered phenols, alkylated phenols, alkyl amines, aryl amines, 2,6-di-tert-butyl-4-methylphenol, 4,4'-di-tert-octyldiphenylamine, tert-butyl hydroquinone, tris(2,4-di-tert-butylphenyl)phosphate, phosphites, thioesters, and combinations thereof.

23. The macro-composition of claim 13, wherein the intermediate layer comprises an anti-corrosion material comprising at least one material selected from the group consisting of alkaline earth metal bisalkylphenolsulphonates, dithiophosphates, alkenylsuccinic acid half-amides, and combinations thereof.

24. The macro-composition of claim 13, wherein the active capping layer comprises one or more materials which are a member of the group consisting of oil, grease, alcohol, composite oil, canola oil, vegetable oils, soybean oil, corn oil, ethyl and methyl esters of rapeseed oil, distilled monoglycerides, monoglycerides, diglycerides, acetic acid esters of monoglycerides, organic acid esters of monoglycerides, sorbitan, sorbitan esters of fatty acids, propylene glycol esters of fatty acids, polyglycerol esters of fatty acids, hydrocarbon oils, n-hexadecane, phospholipids, and combinations thereof.

* * * * *